US010350776B2

(12) United States Patent
Greve et al.

(10) Patent No.: US 10,350,776 B2
(45) Date of Patent: Jul. 16, 2019

(54) CUTOFF KNIFE SERRATION

(71) Applicant: Zenith Cutter, Inc., Loves Park, IL (US)

(72) Inventors: Timothy R. Greve, Davis, IL (US); Mark J. Johnson, Edgerton, WI (US)

(73) Assignee: Zenith Cutter, Inc., Loves Park, IL (US)

( * ) Notice: Subject to any disclaimer, the term of this patent is extended or adjusted under 35 U.S.C. 154(b) by 212 days.

(21) Appl. No.: 15/346,922

(22) Filed: Nov. 9, 2016

(65) Prior Publication Data

US 2017/0326747 A1 Nov. 16, 2017

Related U.S. Application Data

(60) Provisional application No. 62/334,887, filed on May 11, 2016.

(51) Int. Cl.

| | |
|---|---|
| ***B26D 1/00*** | (2006.01) |
| ***B26D 1/36*** | (2006.01) |
| ***B26D 1/62*** | (2006.01) |

(52) U.S. Cl.

CPC ..... *B26D 1/0006* (2013.01); *B26D 1/365* (2013.01); *B26D 1/62* (2013.01); *B26D 2001/006* (2013.01)

(58) Field of Classification Search

CPC ..... B26D 1/0006; B26D 1/365; B26D 1/62; B26D 2001/0053; B26D 2001/0066

See application file for complete search history.

(56) References Cited

U.S. PATENT DOCUMENTS

| | | | | |
|---|---|---|---|---|
| 2,020,996 A | | 11/1935 | Crafts | |
| 3,353,754 A | * | 11/1967 | Heijnis | B02C 18/186 144/162.1 |
| 3,570,337 A | * | 3/1971 | Morgan | B26D 1/0006 83/886 |
| 4,648,537 A | | 3/1987 | Battig | |
| 5,146,820 A | * | 9/1992 | Nemeth | B26D 1/0006 241/236 |
| 5,221,249 A | | 6/1993 | Simpson | |
| 5,445,054 A | | 8/1995 | Pryor | |
| 5,533,431 A | | 7/1996 | Schickling | |
| 5,755,654 A | * | 5/1998 | Schulz | B26D 1/0006 493/350 |
| 6,023,917 A | * | 2/2000 | Cardone | B26D 1/0006 53/133.3 |
| 6,772,663 B2 | | 8/2004 | Machamer | |

(Continued)

FOREIGN PATENT DOCUMENTS

| | | |
|---|---|---|
| CN | 203875964 | 10/2014 |
| EP | 0412383 | 2/1991 |

(Continued)

OTHER PUBLICATIONS

EP17152461.4 Extended European Search Report dated Sep. 20, 2017 (6 pages).

*Primary Examiner* — Omar Flores Sanchez
(74) *Attorney, Agent, or Firm* — Michael Best & Friedrich LLP

(57) ABSTRACT

A pair of cutoff knives configured for mounting on counter-rotating drums such that a serrated edge of one knife of the pair intermeshes with a serrated edge of the other knife of the pair to create a sinusoidal-shaped gap between the intermeshed serrated edges.

20 Claims, 9 Drawing Sheets

(56) References Cited

U.S. PATENT DOCUMENTS

| | | | |
|---|---|---|---|
| 6,874,345 | B2 | 4/2005 | Stoynoff, Jr. |
| 8,342,068 | B2 | 1/2013 | Adami |
| 8,468,938 | B2 | 6/2013 | Redd |
| 2004/0231385 | A1 | 11/2004 | Kergen |
| 2013/0316888 | A1 | 11/2013 | Hsu |
| 2014/0366695 | A1 | 12/2014 | Kien et al. |

FOREIGN PATENT DOCUMENTS

| | | |
|---|---|---|
| EP | 0500411 | 11/1995 |
| GB | 769106 | 2/1957 |
| GB | 1087118 | 10/1967 |
| WO | 2008068015 | 6/2008 |

* cited by examiner

CUTOFF KNIFE SERRATION

CROSS-REFERENCE TO RELATED APPLICATIONS

This application claims priority to co-pending U.S. Provisional Patent Application No. 62/334,887, filed on May 11, 2016, the entire contents of which are incorporated herein by reference.

BACKGROUND

The present invention relates to cutoff knives for use in cutting material (e.g., corrugated material). Corrugated material flows out of a corrugator as a continuous sheet (i.e., a web). The web is typically 8 to 9 feet wide and is moving at approximately 1000 feet per minute. The continuous web is cut into individual sheets by a machine that utilizes counter-rotating cutoff knives.

Early conventional knives had straight edges that contacted each other while cutting the web of material. The constant impacting of the knives with each other resulted in excessive knife and equipment wear. Past attempts at improving the life of the knives included lubricating the knives with oil. However, getting oil on the web of material presented a cleanliness issue, especially for food applications. As such, utilizing lubricant to reduce wear of the knives is not an attractive option for many applications. In an attempt to improve the cut quality, a serrated edge on one blade was used to cut against a standard straight edge. This reduced the creation of long thin strips of paper resulting from a double cut of the inner flute material (i.e., angel hair).

Later conventional cutoff knife designs utilized serrated knives that did not physically contact each other while cutting the web of corrugated material. In the cutoff knife industry, these knives have been referred to as "non-contact knives." The knives were aligned in such a manner that the serration tooth of one knife passed through the valley in the serration of the other knife. Utilizing non-contact knives successfully cut the web of material without the use of lubrication, and since the knives were not contacting each other, it also significantly reduced the wear on the knives and the equipment. However, as explained in detail below, these conventional serrated non-contact knives were unable to achieve a clean cut in many cases.

With reference to FIG. 2, a pair of conventional serrated cutoff knives 10A, 10B is illustrated with the knives 10A, 10B intermeshed. Each of the knives 10A, 10B has a serration 14 that includes a plurality of teeth 18 defined between valleys 22. Due to the method used in grinding the serration 14 into the knives 10A, 10B, the serration valleys 22 have a large radius and the teeth 18 have a flat tip 20. The mating of the tooth 18 of one knife 10A into the radiused valley 22 of the opposing knife 10B results in a variable gap 26 formed between the two knives 10A, 10B. The gap 26 includes a first clearance 30 at the tooth 18 side that is larger than a second clearance 34 at the tooth tip 20. Since a varying clearance gap 26 exists between the cutting edges of the knives 10A, 10B, the cut of corrugated material is not clean and results in fibers being pulled instead of cut. This created a "fuzzy" edge on the cut corrugated material that is a common problem referred to as "fiber pull." The cutting quality becomes even more of a problem when the cutoff knives in FIG. 2 are utilized in a corrugated material application that requires reinforcement tape. In these instances, the reinforcement tape, which is made up of fibers and adhesive, does not cut cleanly due to the variable clearance gap 26 formed by the intermeshed serrations 14.

With reference to FIG. 3, another pair of conventional serrated cutoff knives 50A, 50B is illustrated with the knives 50A, 50B intermeshed. Each of the knives 50A, 50B has a serration 54 that includes a plurality of teeth 58 defined between valleys 62. Each tooth 58 includes a flat apex 66 while the valleys 62 include a radius. The mating of the flat tooth 58 of one knife 50A into the radiused valley 62 of the opposing knife 50B results in a variable gap 70 formed between the two knives 50A, 50B. When the conventional serrated cutoff knives 50A, 50B are mated together, the large flat 66 defines a first clearance 74 that is larger than a second clearance 78 at the tooth 58 side. While the knives of FIG. 3 allow for a smaller clearance along the tooth 58 sides than the knives of FIG. 2 (i.e., clearance 78 of FIG. 3 is smaller than clearance 30 of FIG. 2), there is still a large clearance 74 between the tooth flat 66 and the radiused valley 62. As such, since a varying clearance gap 70 exists between the cutting edges of the knives 50A, 50B, the cut of corrugated material is not clean and results in fibers being pulled instead of cut.

SUMMARY

In one aspect, the invention provides a pair of cutoff knives configured for mounting on counter-rotating drums such that a serrated edge of one knife of the pair intermeshes with a serrated edge of the other knife of the pair to create a sinusoidal-shaped gap between the intermeshed serrated edges.

In another aspect, the invention provides a machine for cutting a web of material into sheets. The machine includes a pair of counter-rotating drums, a first cutoff knife mounted to a first one of the pair of counter-rotating drums, and a second cutoff knife mounted to a second one of the pair of counter-rotating drums. Rotation of the counter-rotating drums causes a serrated edge of the first cutoff knife to intermesh in a non-contacting manner with a serrated edge of the second cutoff knife to create a sinusoidal-shaped gap between the intermeshed serrated edges.

In another aspect, the invention provides a cutoff knife including a body and a serrated edge. The serrated edge is defined by a plurality of teeth with a constant radius that ranges from 0.01 inches to 0.04 inches, a plurality of valleys with the constant radius, and a plurality of linear portions interconnecting the teeth and the valleys. The plurality of linear portions extend a length that ranges from 0.01 inches to 0.04 inches, and adjacent linear portions extend along axes that define an angle therebetween that ranges from 70 degrees to 95 degrees.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
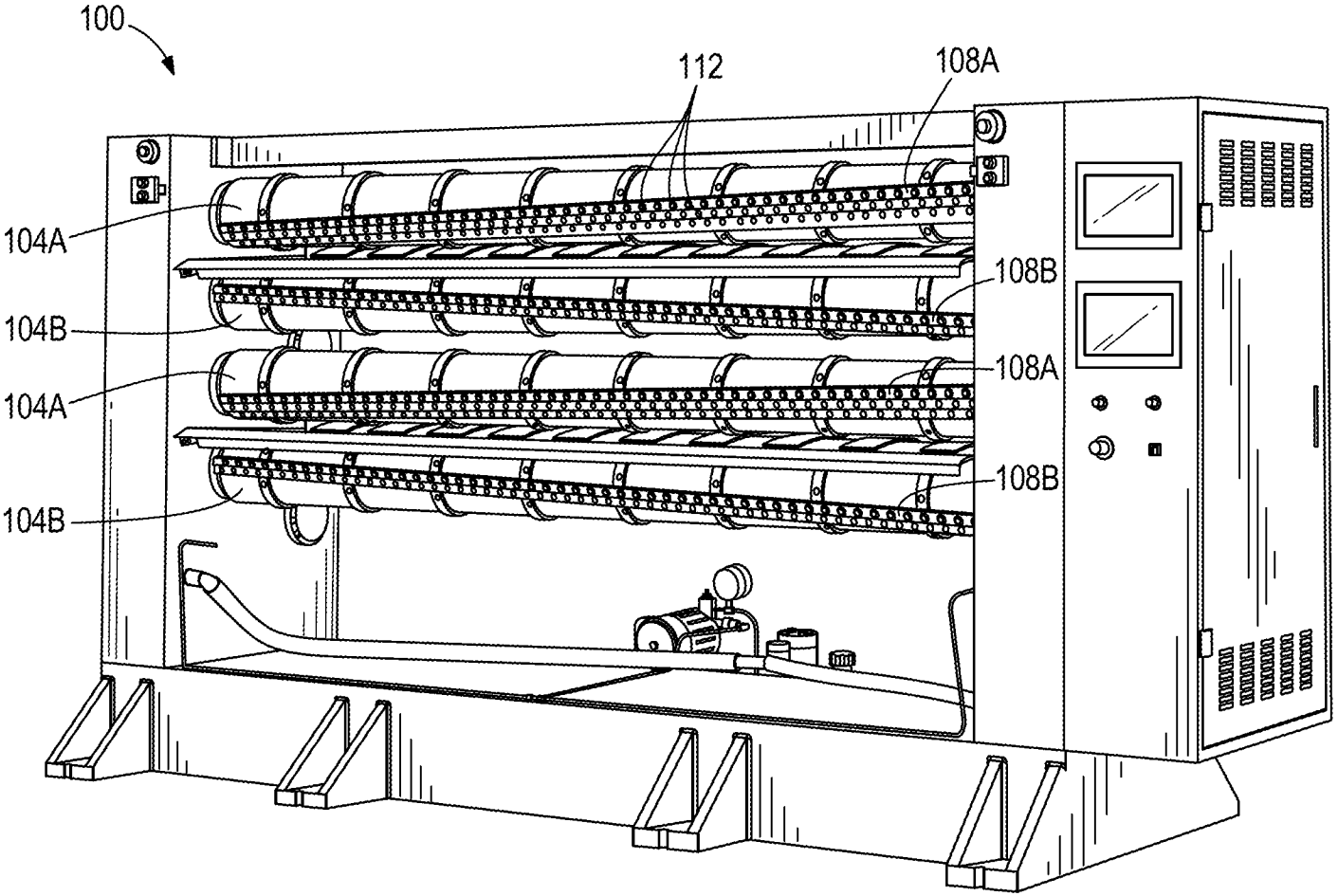
FIG. 1 is a perspective view of a machine for cutting a web of material including a plurality of cutoff knives.
Figure 2:
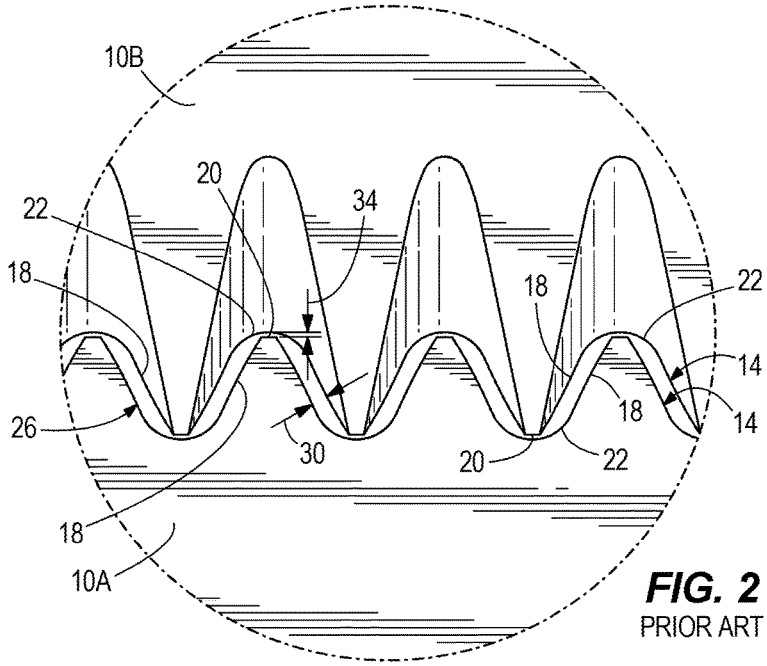
FIG. 2 PRIOR ART
FIG. 2 is an enlarged partial view of two conventional cutoff knives intermeshed.
Figure 3:
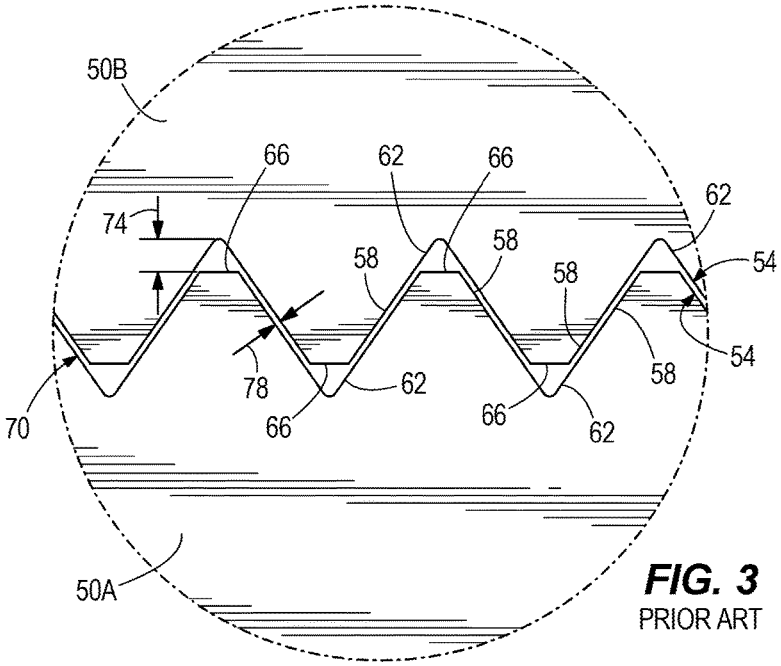
FIG. 3 PRIOR ART
FIG. 3 is an enlarged partial view of two conventional cutoff knives intermeshed.

With reference to FIG. 1, a machine 100 for cutting a web of corrugated material (not shown) into sheets is illustrated. The machine 100 includes two pairs of counter-rotating drums 104A, 104B. A first cutoff knife 108A is mounted to a first drum 104A and a second cutoff knife 108B is mounted to a second drum 104B. In the illustrated embodiment, one cutoff knife is mounted on each drum via fasteners 112, and each of the cutoff knives 108A, 108B is wrapped around a portion of the drums 104A, 104B to create a helix-like curve (i.e., in a helical manner). In other words, the cutoff knife 108A is mounted to the drum 104A in a helical shape. In the illustrated embodiment, each of the cutoff knives 108A, 108B is at least 50 inches in length (i.e., the dimension extending along the cutting edge). In alternative embodiments, each of the cutoff knives is at least 100 inches in length. The first drum 104A is positioned above the web of material to be cut and the second drum 104B is positioned below the web of material. As such, the illustrated machine 100 is operable to cut two webs of material simultaneously. The machine 100 is operable to rotate the drums 104A, 104B via an electric drive, a hydraulic drive, or any other suitable drive. As explained in greater detail below, as the drums 104A, 104B rotate, the knives 108A, 108B move past each other without contacting each other to cut (i.e., shear) the web of material (i.e., the knives 108A, 108B are non-contact knives).

Figure 4:
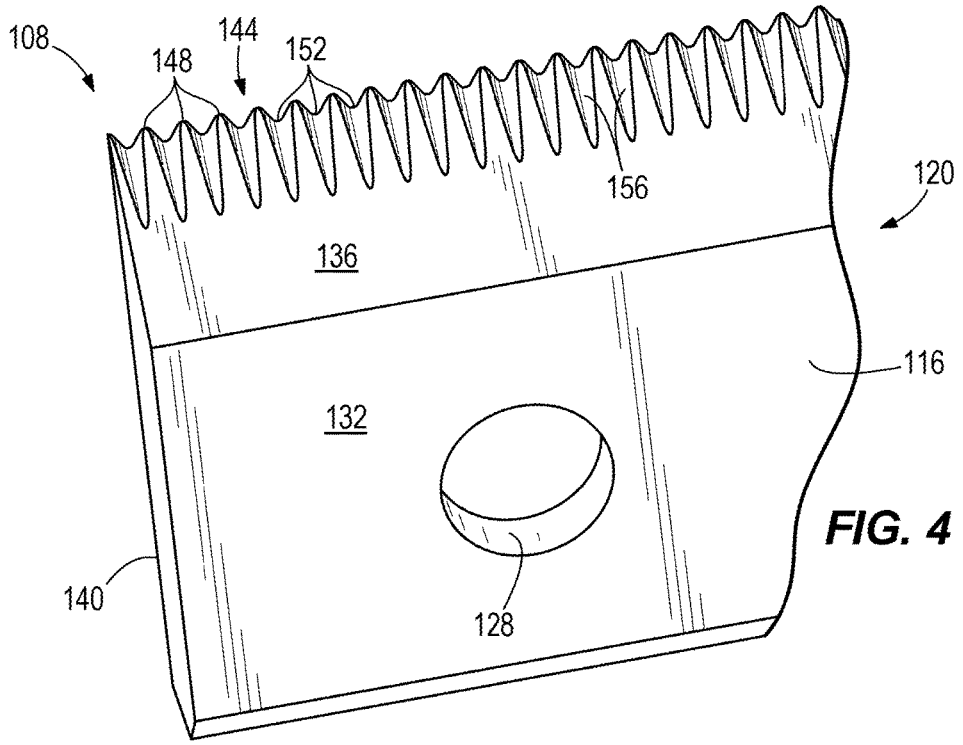
FIG. 4 is a back partial view of a cutoff knife according to an embodiment of the invention.
Figure 5:
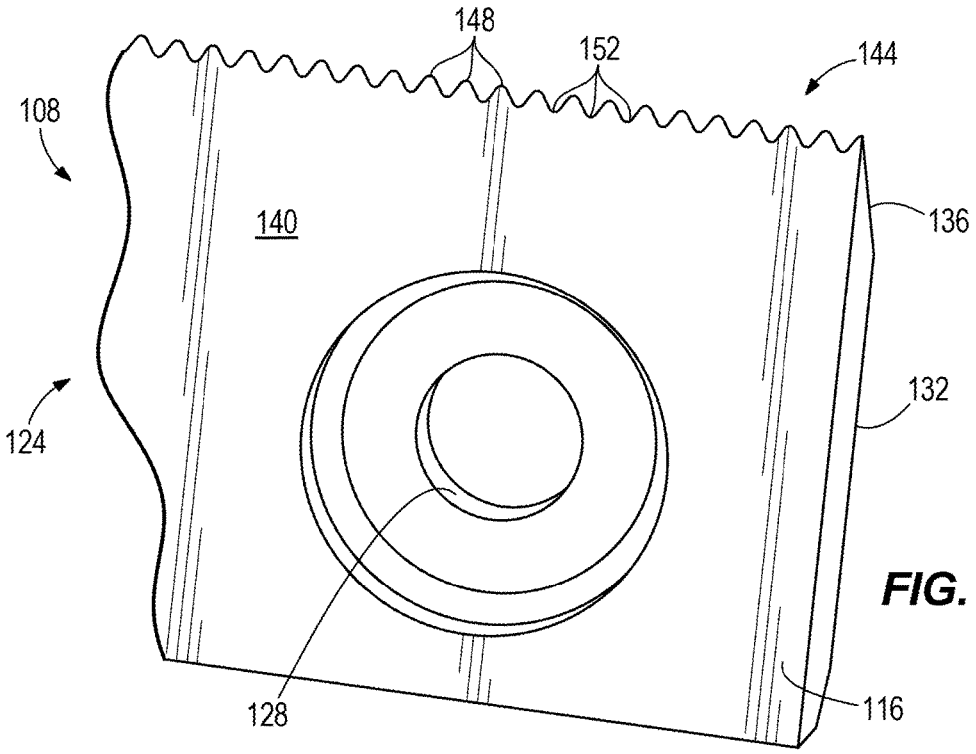
FIG. 5 is a front partial view of the cutoff knife of FIG. 4.

With reference to FIGS. 4 and 5, the cutoff knife 108 according to a first embodiment is illustrated in greater detail. The cutoff knife 108 includes a body 116 having a beveled side 120 (FIG. 4) and a second, opposite flat side 124 (FIG. 5). The body 116 includes a plurality of mounting holes 128 formed therein to receive the fasteners 112 that mount the knife 108 to the drums 104A, 104B. The beveled side 120 includes a planar surface 132, in which the mounting holes 128 are located, and a beveled surface 136 extending from the planar surface 132. The flat side 124 includes a single flat surface 140 (i.e., the flat). The beveled surface 136 extends between the planar surface 132 on the beveled side 120 and the single flat surface 140 on the flat side 124. A serrated cutting edge 144 is formed where the beveled surface 136 intersects the flat surface 140. The serrated cutting edge 144 (i.e., the serration, the serrated edge, etc.) is defined by a plurality of teeth 148 separated by a plurality of valleys 152. The serrated cutting edge 144 is formed by a machining process (e.g., grinding process) that, in the embodiment shown in FIGS. 4 and 5, is performed on the beveled surface 136 of the beveled side 120. Grooves 156 are formed in the beveled surface 136 by the serration machining process. In other words, in the illustrated embodiment, formation of the serrated edge 144 creates a plurality of grooves 156 in the beveled surface 136. The serration 144 geometry and dimensions, along with alternatives, are described in greater detail below with respect to FIGS. 9-12.

Figure 6:
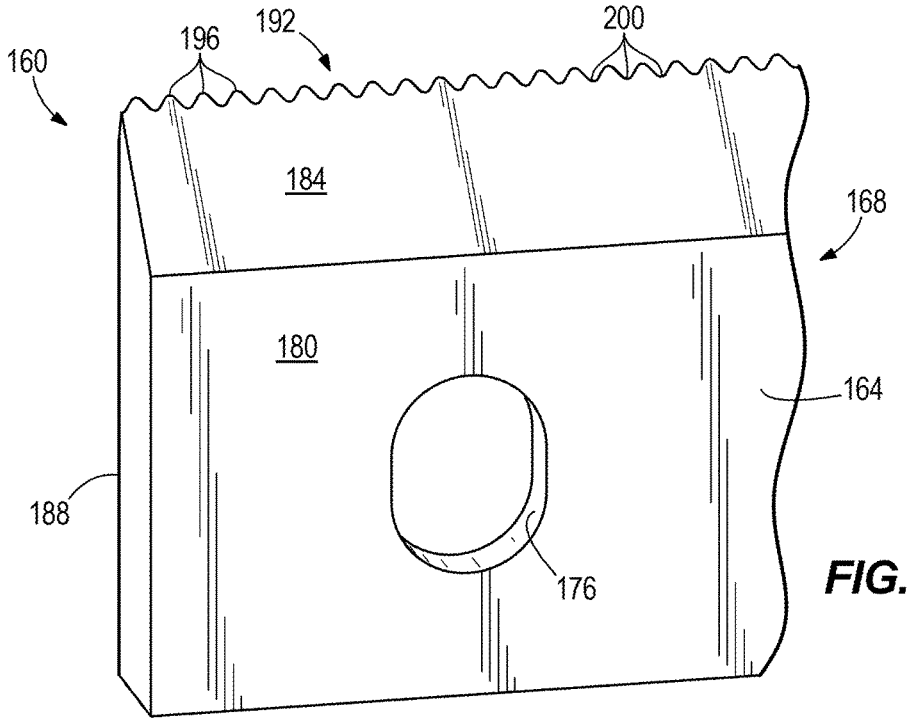
FIG. 6 is a back partial view of a cutoff knife according to an embodiment of the invention.
Figure 7:
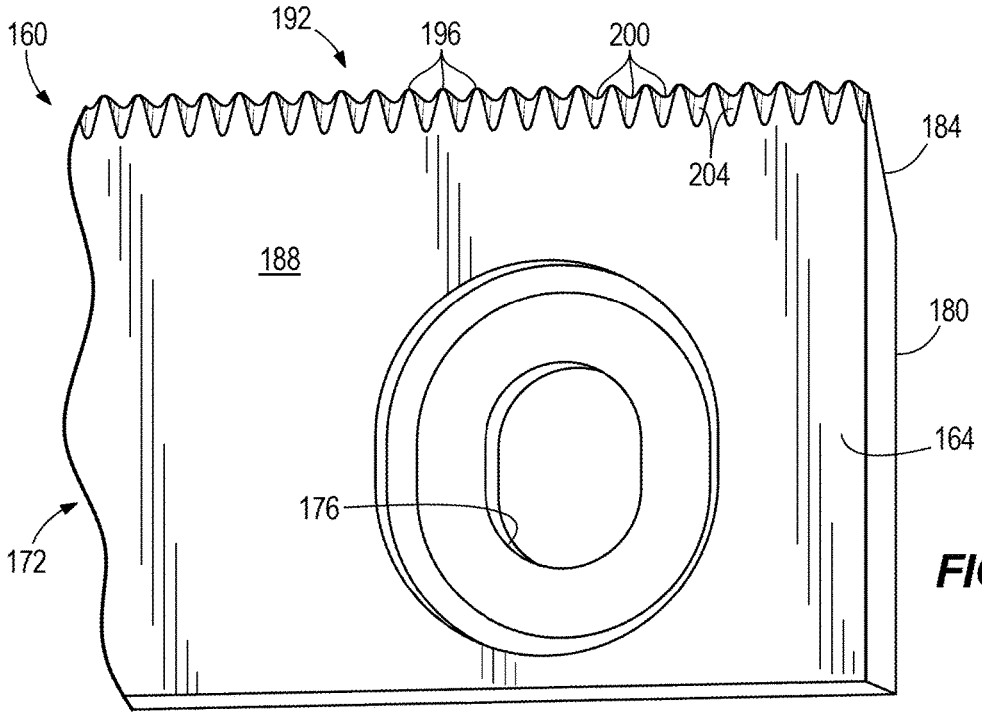
FIG. 7 is a front partial view of the cutoff knife of FIG. 6.

With reference to FIGS. 6 and 7, a cutoff knife 160 according to a second embodiment is illustrated in greater detail. The cutoff knife 160 includes a body 164 having a beveled side 168 (FIG. 6) and a second, opposite flat side 172 (FIG. 7). The body 164 includes a plurality of mounting holes 176 therein to receive the fasteners 112 that mount the knife 160 to the drums 104A, 104B. The beveled side 168 includes a planar surface 180, in which the mounting holes 176 are located, and a beveled surface 184 extending from the planar surface 180. The flat side 172 includes a single flat surface 188 (i.e., the flat). The beveled surface 184 extends between the planar surface 180 on the beveled side 168 and the single flat surface 188 on the flat side 172. A serrated cutting edge 192 is formed where the beveled surface 184 intersects the flat surface 188. The serrated cutting edge 192 (i.e., the serration, the serrated edge, etc.) is defined by a plurality of teeth 196 separated by a plurality of valleys 200. The serrated cutting edge 192 is formed by a machining process (e.g., grinding process) that, in the embodiment shown in FIGS. 6 and 7, is performed on the flat surface 188 of the flat side 172. Grooves 204 are formed in the flat surface 188 by the serration machining process. In other words, in the illustrated embodiment, formation of the serrated edge 192 creates a plurality of grooves 204 in the flat surface 188.

Figure 8:
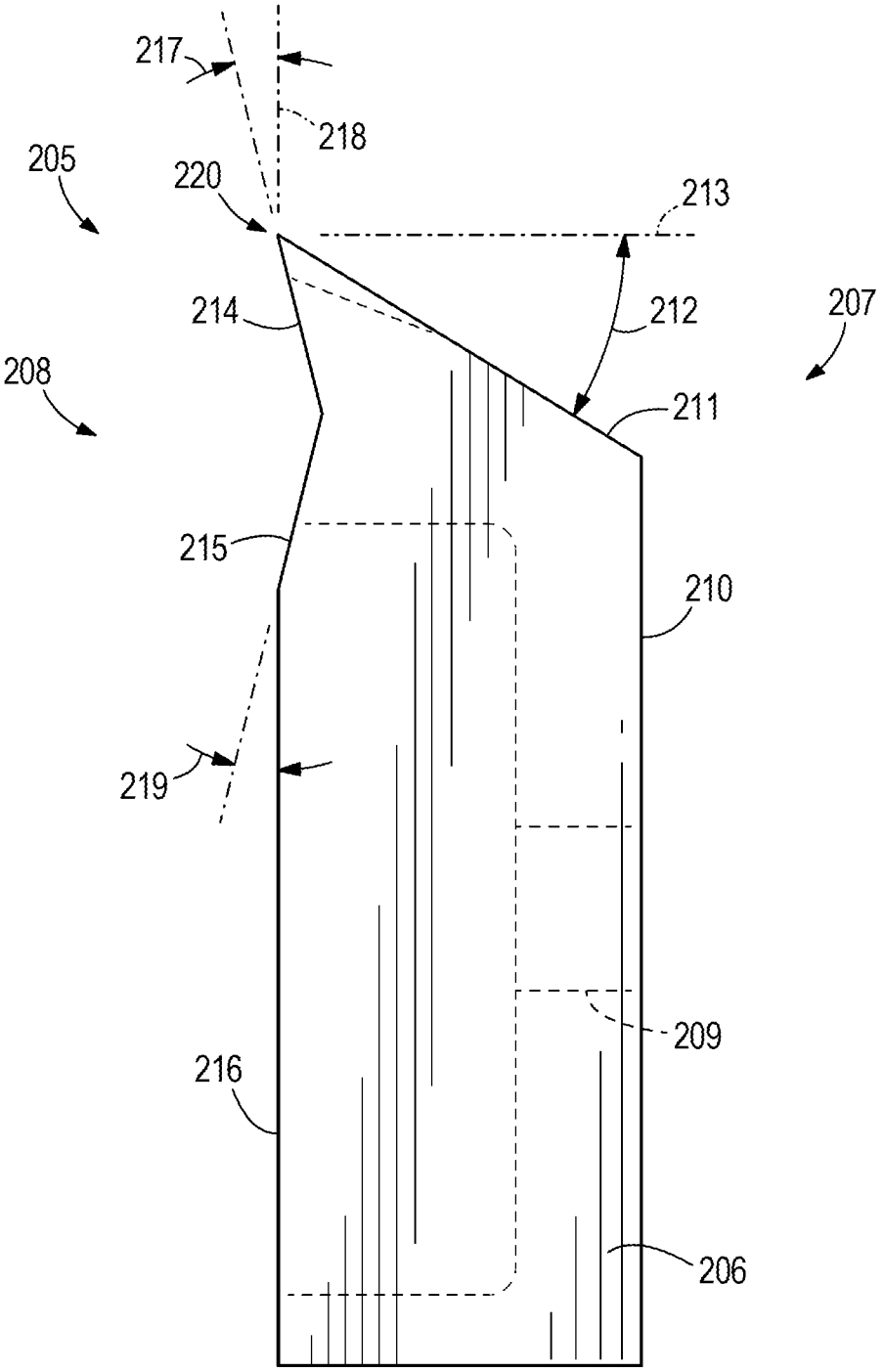
FIG. 8 is a side view of a cutoff knife according to an embodiment of the invention.

With reference to FIG. 8, a cutoff knife 205 according to a third embodiment is illustrated in greater detail. The cutoff knife 205 is similar to the knife 108 of FIGS. 4 and 5, and includes a body 206 having a beveled side 207 and a second, opposite side 208. The body 206 includes a plurality of mounting holes 209 therein to receive the fasteners 112 that mount the knife 205 to the drums 104A, 104B. The beveled side 207 includes a planar surface 210, in which the mounting holes 209 are located, and a beveled surface 211 extending from the planar surface 210. The beveled surface 211 defines a bevel angle 212 that extends from a horizontal axis 213 (i.e., perpendicular to the planar surface 210), as shown in FIG. 8. In the illustrated embodiment, the bevel angle 212 is approximately 32 degrees. In alternative embodiments, the bevel angle 212 ranges from approximately 20 degrees to approximately 60 degrees. The second side 208 includes a first angled surface 214, a second angled surface 215 and a flat surface 216. The first angled surface 214 extends from beveled surface 211 and defines a first angle 217 that extends from a vertical axis 218 (i.e., parallel to the planar surface 210), as shown in FIG. 8. In the illustrated embodiment, the first angle 217 is approximately 14 degrees. In alternative embodiments, the first angle 217 ranges from approximately 3 degrees to approximately 20 degrees. The second angled surface 215 extends between the first angled surface 214 and the flat surface 216, and defines a second angle 219 that extends from the vertical axis 218, as shown in FIG. 8. In the illustrated embodiment, the second angle 219 is approximately 14 degrees. In other words, in the illustrated embodiment, the first angle 217 is equal to the second angle 219. In alternative embodiments, the second angle 219 ranges from approximately 3 degrees to approximately 20 degrees. A serrated cutting edge 220 is formed where the beveled surface 211 intersects the first angled surface 214. The serrated cutting edge 220 (i.e., the serration, the serrated edge, etc.) is defined by a plurality of teeth separated by a plurality of valleys (not shown in FIG. 8). The first and second angled surfaces 214, 215 create a relief that thins the cutting edge 220, making the cutting edge 220 less blunt. The first and second angles 217, 219 can be adjusted depending on how the knife 205 is mounted to the drums 104A, 104B.

Figure 9A:
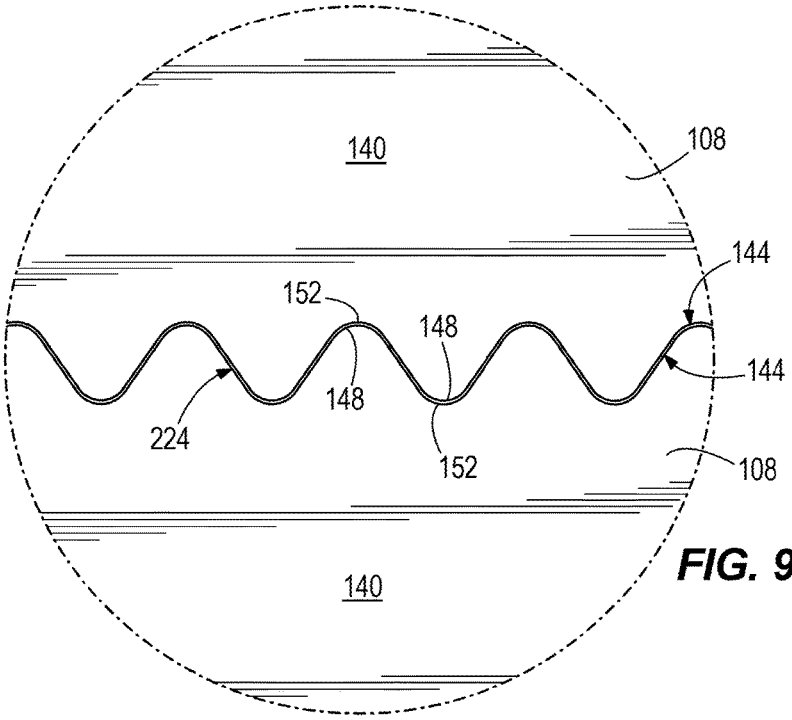
FIG. 9A is an enlarged partial view of two cutoff knives of FIG. 4 intermeshed.
Figure 9B:
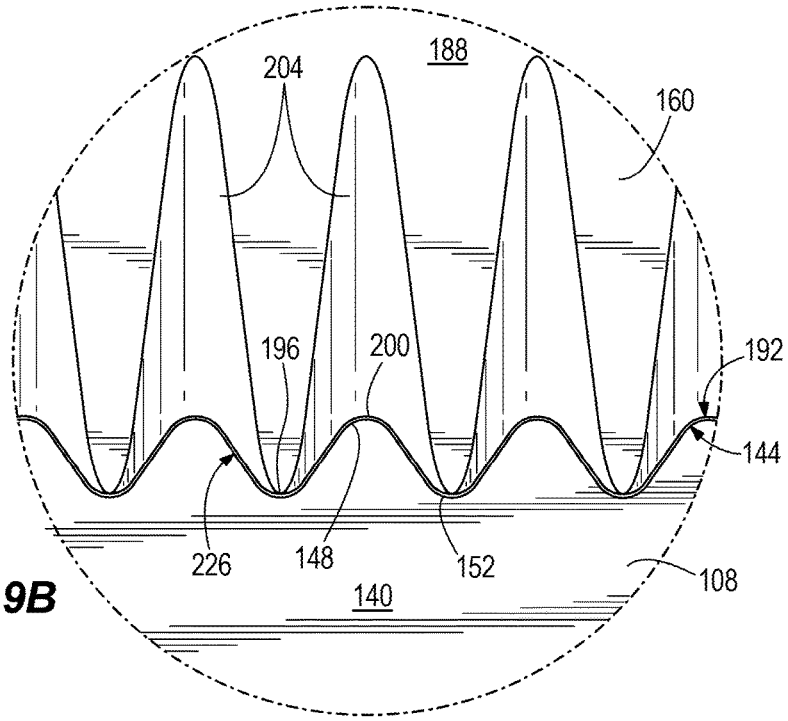
FIG. 9B is an enlarged partial view of one cutoff knife of FIG. 4 and one cutoff knife of FIG. 6 intermeshed.
Figure 9C:
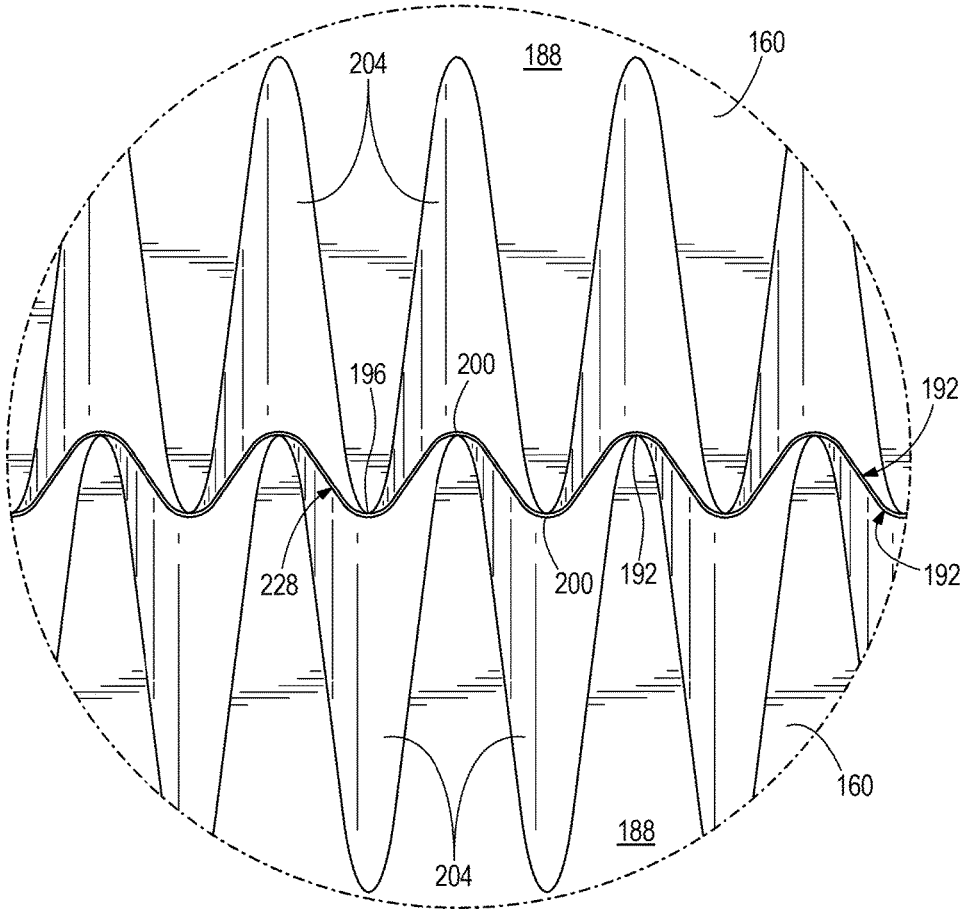
FIG. 9C is an enlarged partial view of two cutoff knifes of FIG. 6 intermeshed.

With respect to FIGS. 9A, 9B, and 9C, pairs of cutoff knives are illustrated using various combinations of the knives 108 (FIGS. 4-5) and the knives 160 (FIG. 6-7). More specifically, FIG. 9A illustrates two of the knives 108 intermeshed; FIG. 9B illustrates one knife 108 intermeshed with one knife 160; and FIG. 9C illustrates two of the knives 160 intermeshed. The enlarged views of FIGS. 9A, 9B, and 9C illustrate how the serrations of the knives intermesh in a non-contacting manner as they move past each other when the counter-rotating drums 104A, 104B rotate. In other words, the knives 108, 160 are non-contact knives that do not engage one another when the serrated edges 144, 192 are intermeshed.

With respect to FIG. 9A, a pair of cutoff knifes 108 (as shown in FIGS. 4 and 5) is illustrated. The pair of cutoff knives 108 are configured for mounting on counter-rotating drums 104A, 104B such that the serrated edge 144 of one knife 108 intermeshes with the serrated edge 144 of the other knife 108. The pair of cutoff knives 108 create a sinusoidal-shaped (i.e., wave shaped) gap 224 between the intermeshed serrated edges 144. The sinusoidal-shaped gap 224 is uniform throughout, having a constant width of approximately 0.005 inches. Alternatively, the gap 224 is a constant width of no more than approximately 0.005 inches. In further alternatives, the gap 224 is a constant width that ranges from approximately 0.005 inches to approximately 0.020 inches.

The term "sinusoidal-shaped gap" is used throughout this description and encompasses pure (i.e., exact) sinusoid shapes as well as approximated (i.e., substantially) sinusoidal shapes. Approximated sinusoidal shapes include curved portions connected by linear portions. Additionally, approximated sinusoidal shapes include curved portions having a constant radius connected by linear portions.

With reference to FIG. 9B, a pair of cutoff knives 108, 160 (with one knife as shown in FIGS. 4-5 and the other as shown in FIGS. 6-7) is illustrated such that the serrated edge 144 of one knife 108 intermeshes with the serrated edge 192 of the other knife 160. The pair of cutoff knives 108, 160 create a sinusoidal-shaped gap 226 between the intermeshed serrated edges 144, 192. The sinusoidal-shaped gap 226 is uniform throughout, similar to the sinusoidal-shaped gap 224 of FIG. 9A.

With reference to FIG. 9C, a pair of cutoff knives 160 (as shown in FIGS. 6 and 7) is illustrated such that the serrated edge 192 of one knife 160 intermeshes with the serrated edge 192 of the other knife 160. The pair of cutoff knives 160 create a sinusoidal-shaped gap 228 between the intermeshed serrated edges 192. The sinusoidal-shaped gap 228 is uniform throughout, similar to the sinusoidal-shaped gaps 224 and 226 of FIGS. 9A and 9B, respectively. As demonstrated, the sinusoidal-shaped gap 224, 226, 228 is created regardless of whether knives 108 according to FIGS. 4 and 5 are utilized, the knives 160 according to FIGS. 6 and 7 are utilized, or a combination of both knives 108, 160 are utilized.

With reference to FIGS. 9-12, various serration geometries are described in greater detail. The illustrated serration geometries may be utilized an either the cutoff knife 108 of FIGS. 4 and 5 or the cutoff knife 160 of FIGS. 6 and 7.

Figure 10:
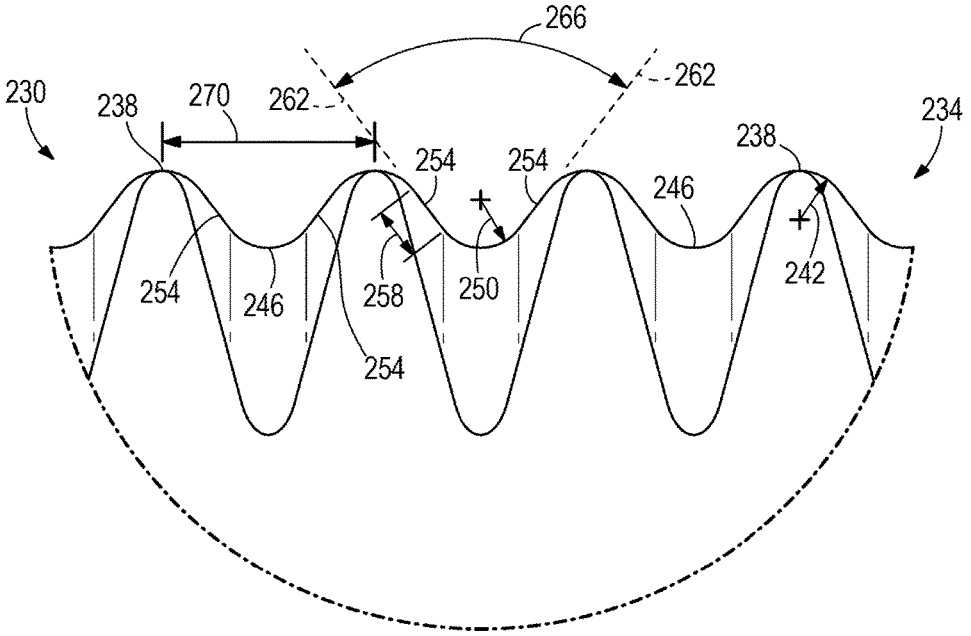
FIG. 10 is an enlarged partial view of a serration according to an embodiment of the invention.

With reference to FIG. 10, a serration geometry 230 according to a first embodiment is illustrated. The serration geometry 230 includes a serrated edge 234 defined by a plurality of teeth 238 with a constant radius 242, a plurality of valleys 246 with a constant radius 250, and a plurality of linear portions 254 interconnecting the teeth 238 and the valleys 246 (i.e., the serration geometry 230 is sinusoidal-shaped). The constant radius 242 of the teeth 238 is equal to the constant radius 250 of the valleys 246, and in the illustrated embodiment, the constant radius is approximately 1/64 of an inch (i.e., approximately 0.016 inches). The plurality of linear portions 254 extend a length 258 that is approximately 0.030 inches in the illustrated embodiment. Adjacent linear portions 254 extend along axes 262 that define an angle 266 therebetween. In the illustrated embodiment, the angle 266 is approximately 75 degrees. The serration geometry 230 of FIG. 10 includes a tooth per inch value of approximately 11.8, with a tooth tip-to-tip distance 270 of approximately 0.085 inches.

Figure 11:
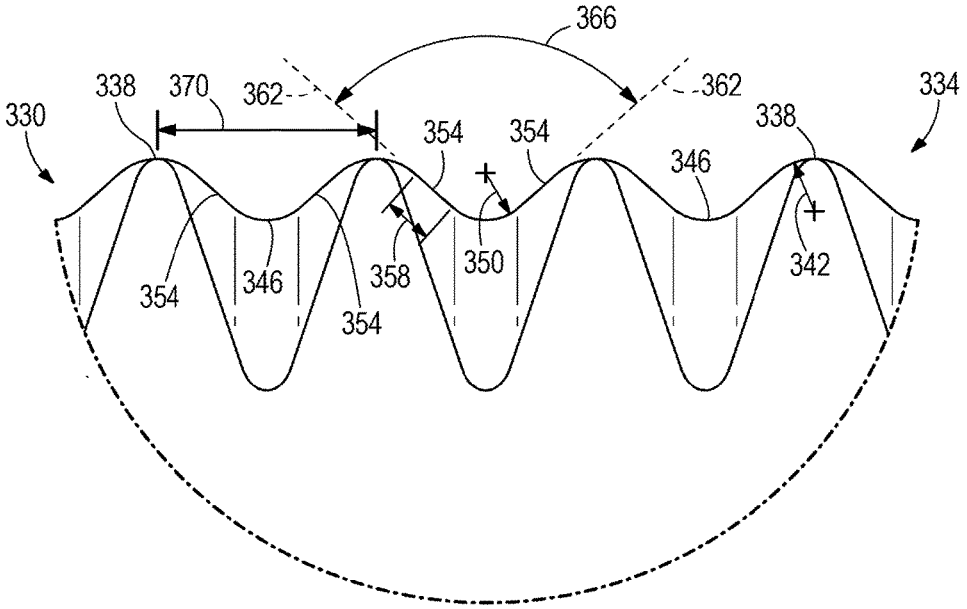
FIG. 11 is an enlarged partial view of a serration according to an embodiment of the invention.

With reference to FIG. 11, a serration geometry 330 according to a second embodiment is illustrated. The serration geometry 330 includes a serrated edge 334 defined by a plurality of teeth 338 with a constant radius 342, a plurality of valleys 346 with a constant radius 350, and a plurality of linear portions 354 interconnecting the teeth 338 and the valleys 346 (i.e,. the serration geometry 330 is sinusoidal-shaped). The constant radius 342 of the teeth 338 is equal to the constant radius 350 of the valleys 346, and in the illustrated embodiment, the constant radius is approximately 1/64 of an inch (i.e., approximately 0.016 inches). The plurality of linear portions 354 extend a length 358 that is approximately 0.030 inches in the illustrated embodiment. Adjacent linear portions 354 extend along axes 362 that define an angle 366 therebetween. In the illustrated embodiment, the angle 366 is approximately 90 degrees. The serration geometry 330 of FIG. 11 includes a tooth per inch value of approximately 10.5, with a tooth tip-to-tip distance 370 of approximately 0.095 inches.

Figure 12:
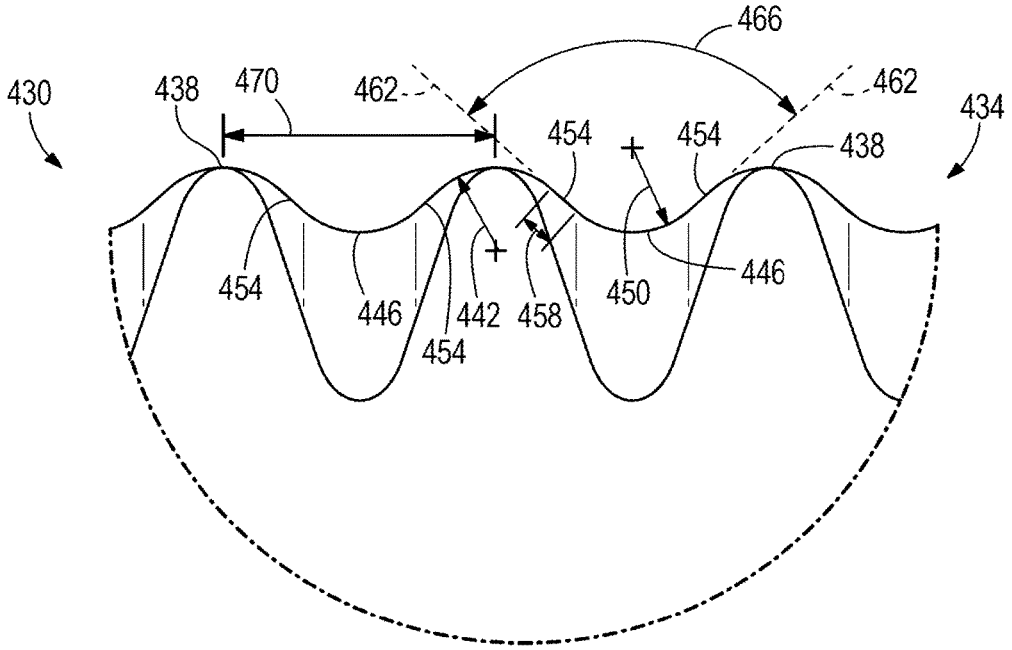
FIG. 12 is an enlarged partial view of a serration according to an embodiment of the invention.

With reference to FIG. 12, a serration geometry 430 according to a third embodiment is illustrated. The serration geometry 430 includes a serrated edge 434 defined by a plurality of teeth 438 with a constant radius 442, a plurality of valleys 446 with a constant radius 450, and a plurality of linear portions 454 interconnecting the teeth 438 and the valleys 446 (i.e., the serration geometry 430 is sinusoidal-shaped). The constant radius 442 of the teeth 438 is equal to the constant radius 450 of the valleys 446, and in the illustrated embodiment, the constant radius is approximately 1/32 of an inch (i.e., approximately 0.0312 inches). The plurality of linear portions 454 extend a length 458 that is approximately 0.017 inches in the illustrated embodiment. Adjacent linear portions 454 extend along axes 462 that define an angle 466 therebetween. In the illustrated embodiment, the angle 466 is approximately 90 degrees. The serration geometry 430 of FIG. 11 includes a tooth per inch value of approximately 8.2, with a tooth tip-to-tip distance 470 of approximately 0.122 inches.

Figure 13:
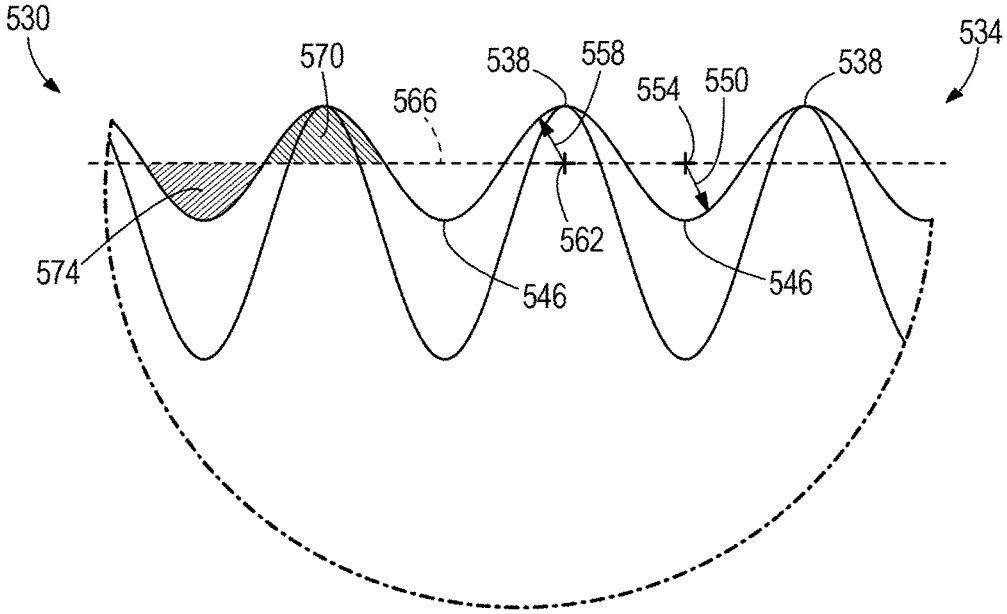
FIG. 13 is an enlarged partial view of a serration according to an embodiment of the invention.

With reference to FIG. 13, a serration geometry 530 according to a fourth embodiment is illustrated. The serration geometry 530 includes a serrated edge 534 defined by a plurality of teeth 538 separated by a plurality of valleys 546. The teeth 538 and the valleys 546 form an exact sinusoidal shape (i.e., the serration geometry 530 is an exact sinusoid). With the pure sinusoidal shape, a radius 550 taken from a first center point 554 at one point along the valley 546 is equal to a radius 558 taken from a second center point 562 at a corresponding point along the tooth 538. In other words, the teeth 538 and the valleys 546 have the same radii 550, 558 at various points along the teeth 538 and the valleys 546. While a true sinusoidal shape does not have a "radius" because the slope of a sinusoid is constantly changing, for the purposes of this description, the term "radius" and "radii" is used to describe the length from a center point that is aligned with either the peak or valley to the sinusoidal curve. In particular, the first center point 554 and the second center point 562 are positioned along a common horizontal axis 566, with the first center point 554 aligned with the lowest point on the valley 546 and the second center point 562 aligned with the highest point on the teeth 538. The serration geometry 530 is mirrored about the horizontal axis 566 such that the cross-sectional area 570 of the tooth 538 above the horizontal axis 566 as view in FIG. 13 is equal to the cross-sectional area 574 of the valley 546 below the horizontal axis 566.

In further alternatives with the serration geometry formed as an approximate sinusoid, the constant radius of the teeth and the valleys ranges from approximately 0.01 inches to approximately 0.04 inches. In addition, each of the linear portions alternatively extends a length that ranges from approximately 0.01 inches to approximately 0.04 inches. Further, adjacent linear portions extend along axes that define an angle therebetween that ranges from approximately 70 degrees to approximately 95 degrees. These dimensions are representative only, and further alternative dimensions can be substituted to obtain the desired intermeshing configuration. The illustrated knives 108, 160 can utilize any of the above described serration geometries 230, 330, 430, 530.

All of the illustrated and described serration geometries 230, 330, 430, 530 create a uniform, sinusoidal-shaped gap when intermeshed with a second serration geometry having the same geometry as the first (FIGS. 9A, 9B, 9C). As such, cut quality with corrugated material, including material using reinforcement tapes, is improved. When these serration geometries 230, 330, 430, 530 are intermeshed, the clearance therebetween creates a small, homogenous, substantially sinusoidal-shaped gap between the intermeshed serrated edges (FIGS. 9A, 9B, 9C). As a result, the amount of fiber pulling is reduced, even with applications for cutting tape-reinforced corrugated material. No lubrication is required between the knives, and the angel-hair and fiber pull problems of conventional knives are reduced or eliminated.

Various features and advantages of the invention are set forth in the following claims.

What is claimed is:

1. A pair of cutoff knives configured for mounting on counter-rotating drums such that a serrated edge of one knife of the pair intermeshes with a serrated edge of the other knife of the pair to create a sinusoidal-shaped gap between the intermeshed serrated edges;

wherein the serrated edges are defined by a plurality of radiused teeth separated by a plurality of radiused valleys.

2. The pair of cutoff knives of claim 1, wherein the teeth and the valleys have the same radii.

3. The pair of cutoff knives of claim 1, wherein the knives are non-contact knives that do not engage one another when the serrated edges are intermeshed.

4. The pair of cutoff knives of claim 1, wherein the serrated edges are defined by the plurality of radiused teeth having a constant radius, the plurality of radiused valleys having the constant radius, and a plurality of linear portions interconnecting the teeth and the valleys.

5. The pair of cutoff knives of claim 4, wherein the constant radius ranges from 0.01 inches to 0.04 inches.

6. The pair of cutoff knives of claim 4, wherein the plurality of linear portions extend a length that ranges from 0.01 inches to 0.04 inches.

7. The pair of cutoff knives of claim 4, wherein adjacent linear portions extend along axes that define an angle therebetween, and wherein the angle ranges from 70 degrees to 95 degrees.

8. The pair of cutoff knives of claim 1, wherein the teeth and the valleys form an exact sinusoid.

9. The pair of cutoff knives of claim 1, wherein each of the cutoff knives is at least 50 inches in length.

10. The pair of cutoff knives of claim 1, wherein the sinusoidal-shaped gap has a uniform width.

11. A machine for cutting a web of material into sheets, the machine comprising:

a pair of counter-rotating drums;

a first cutoff knife mounted to a first one of the pair of counter-rotating drums; and a second cutoff knife mounted to a second one of the pair of counter-rotating drums;

wherein rotation of the counter-rotating drums causes a serrated edge of the first cutoff knife to intermesh in a non-contacting manner with a serrated edge of the second cutoff knife to create a sinusoidal-shaped gap between the intermeshed serrated edges; and wherein the serrated edges of each of the first and second knives are defined by a plurality of radiused teeth separated by a plurality of radiused valleys.

12. The machine of claim 11, wherein the teeth and the valleys of each of the first and second cutoff knives have the same radii.

13. The machine of claim 11, wherein the serrated edges of the first and second cutoff knives are defined by the plurality of radiused teeth having a constant radius, the plurality of radiused valleys having the constant radius, and a plurality of linear portions interconnecting the teeth and the valleys.

14. The machine of claim 11, wherein the teeth and the valleys of the first and second cutoff knives form an exact sinusoid.

15. The machine of claim 11, wherein the first cutoff knife is mounted to the first one of the pair of counter-rotating drums in a helical shape.

16. The machine of claim 11, wherein the sinusoidal-shaped gap has a uniform width.

17. A cutoff knife comprising:

a body; and a serrated edge, wherein the serrated edge is defined by a plurality of teeth with a constant radius that ranges from 0.01 inches to 0.04 inches, a plurality of valleys with the constant radius, and a plurality of linear portions interconnecting the teeth and the valleys, wherein the plurality of linear portions extend a length that ranges from 0.01 inches to 0.04 inches, and wherein adjacent linear portions extend along axes that define an angle therebetween that ranges from 70 degrees to 95 degrees.

18. The cutoff knife of claim 17, wherein the constant radius is 1/64 of an inch, the length of each of the plurality of linear portions is 0.03 inches, and the angle defined between adjacent linear portions is 75 degrees.

19. The cutoff knife of claim 17, wherein the body includes a beveled surface and a first angled surface intersecting the beveled surface at the serrated edge, and wherein the body further includes a second angled surface extending from the first angled surface.

20. The cutoff knife of claim 17, wherein the body includes a beveled surface and a flat surface, and wherein formation of the serrated edge creates a plurality of grooves in the beveled surface or the flat surface.

* * * * *